US009668328B2

(12) United States Patent
Brar et al.

(10) Patent No.: US 9,668,328 B2
(45) Date of Patent: May 30, 2017

(54) NIGHT-LIGHT AND ALERT SYSTEM

(71) Applicant: Nightingale Home Healthcare, Carmel, IN (US)

(72) Inventors: Dev Brar, Carmel, IN (US); Shawn Bashore, Carmel, IN (US)

(73) Assignee: Nightingale Home Healthcare, Indianapolis, IN (US)

( * ) Notice: Subject to any disclaimer, the term of this patent is extended or adjusted under 35 U.S.C. 154(b) by 0 days.

(21) Appl. No.: 14/920,454

(22) Filed: Oct. 22, 2015

(65) Prior Publication Data

US 2017/0118823 A1 Apr. 27, 2017

(51) Int. Cl.

| | |
|---|---|
| ***H05B 37/02*** | (2006.01) |
| ***G08B 5/36*** | (2006.01) |
| ***G08C 17/02*** | (2006.01) |
| ***G08B 25/00*** | (2006.01) |
| ***H05B 37/03*** | (2006.01) |
| ***F21V 37/00*** | (2006.01) |

(52) U.S. Cl.

CPC ..... *H05B 37/0272* (2013.01); *F21V 37/00* (2013.01); *G08B 5/36* (2013.01); *G08B 25/004* (2013.01); *G08C 17/02* (2013.01); *H05B 37/0227* (2013.01); *H05B 37/0245* (2013.01); *H05B 37/0263* (2013.01); *H05B 37/034* (2013.01); *G08C 2200/00* (2013.01)

(58) Field of Classification Search

CPC ..... H05B 37/0245; H05B 37/0263; H05B 37/034; F21V 37/00; F21V 37/0045; F21S 6/004

USPC ..... 315/134, 149, 291, 307, 360

See application file for complete search history.

(56) References Cited

U.S. PATENT DOCUMENTS

| | | | | |
|---|---|---|---|---|
| 4,544,993 | A * | 10/1985 | Kirk | F21S 8/032 362/153 |
| 4,924,214 | A | 5/1990 | Hill | |
| 5,019,950 | A * | 5/1991 | Johnson | A47G 27/0243 200/85 R |
| 5,841,077 | A | 11/1998 | Kolaci | |
| 5,848,830 | A * | 12/1998 | Castle | A47G 27/0243 362/253 |
| 6,297,738 | B1 | 10/2001 | Newham | |
| 6,965,311 | B1 | 11/2005 | Karner | |
| 7,358,861 | B2 * | 4/2008 | Blum | G06Q 30/0241 340/332 |

(Continued)

OTHER PUBLICATIONS

International Search Report for PCT/US2016/057914 dated Jan. 31, 2017.

(Continued)

*Primary Examiner* — Tung X Le

(74) *Attorney, Agent, or Firm* — Woodard, Emhardt, Moriarty, McNett & Henry LLP

(57) ABSTRACT

Among other things, a system for lighting a light for an individual rising from a bed is provided. In particular embodiments, the system can include a mat and a light unit wirelessly connected, so that when an individual steps on the mat as he or she rises from the bed a signal is sent to the light unit, activating the light. A weight sensor in the mat can measure the weight placed on the mat, so that unintentional lighting can be avoided and so that weight information can be recorded. Embodiments can also include a signal transmitter to send weight and activation information to a remote receiver.

11 Claims, 12 Drawing Sheets

(56) References Cited

U.S. PATENT DOCUMENTS

| | | | | |
|---|---|---|---|---|
| 7,572,987 | B2 | 8/2009 | Fenn | |
| 9,212,814 | B2 * | 12/2015 | Puljan | F21V 33/004 |
| 2005/0011738 | A1 | 1/2005 | Smith et al. | |
| 2008/0256445 | A1 | 10/2008 | Olch et al. | |
| 2009/0126139 | A1 * | 5/2009 | Batti | A47G 27/0243 15/216 |
| 2010/0181934 | A1 * | 7/2010 | Chidester | H05B 37/0218 315/307 |
| 2010/0231400 | A1 | 9/2010 | von Mohr | |
| 2011/0175553 | A1 * | 7/2011 | Sampsell | H05B 37/0245 315/312 |
| 2014/0152188 | A1 | 6/2014 | Bora et al. | |
| 2014/0183946 | A1 | 7/2014 | Recker et al. | |

OTHER PUBLICATIONS

"Distance and Weight Measurement Using Inductive Sensing Reference Design", TIDU367, Jun. 2014. http://ww.ti.com/lit/ug/tidu367/tidu367.pdf. See pp. 1, 3, 9, 15-16 and 23-24; and figure 3. Texas Instruments Incorporated.

* cited by examiner

1) Timer 1 :- Time for Multiple detection avoidance.
2) Timer 2 :- Time To Turn OFF Lamp Light.
3) Timer 3 :- Time to Turn Off Mat Led timer.
4) Timer 4 :- Time to turn OFF Lamp light if user stepped on Mat before elapsing of timer 2.

NIGHT-LIGHT AND ALERT SYSTEM

The present disclosure pertains generally to safety and alert devices for use in the bedroom of a patient, elderly, physically disabled, or other individual who may require care. In particular, it concerns systems for providing lighting assistance to such an individual when he or she rises from a bed.

BACKGROUND

When an individual rises from his or her bed, particularly during the night or in dim conditions, he or she may wish to turn on a light in order to be able to safely move around or out of the bedroom. Commonly, the light is on a nightstand, fixed to a wall or ceiling, or in a corner so as to be out of the way yet cast light into the room.

In cases where the light is away from the bed, to use it the individual must make his or her way to the light, and find and operate the switch for the light. Alternatively, if the individual wishes to leave the room, he or she may simply move toward the door, by whatever light may be present, by memory or by feel. Naturally, if the individual is elderly or infirm, such maneuvering in darkness or dim light may present certain hazards, including the possibility of bumping into furniture or other items, or taking a bad step and falling. In cases where the light is close to the bed, for example on an adjacent nightstand, the individual may have to turn his or her body or at least reach uncomfortably for a lamp. If such a turn or reach is possible for the individual, in addition to any physical discomfort there is also the risk of knocking over the lamp or some other item on the nightstand.

Previously suggested solutions include specially-equipped beds, for example with lights wired into the bed, and/or a switch attached to the bed (e.g. a hospital bed) that one who is in the bed can operate. Such technology can be quite complex and expensive, and also can present similar problems in terms of the individual being able to reach and operate such lights or switches in comfort. Another proposed solution involves a mat operating as a switch, so that when one rises from the bed and steps on the mat, a light is automatically lit. Problems associated with such technology include sure operation of the mat, ensuring that the mat is not operated unintentionally, and requiring that the individual step on the mat again to turn off the light.

It would also be desirable for a device that assists an elderly or otherwise infirm person to see around his or her room to also notify a caregiver that the person has left his or her bed, of the fact that he or she has not returned to the bed, and/or data concerning the person. The present disclosure provides such a system.

SUMMARY

Among other things, there is disclosed a wireless night light system for turning on a light remote from an individual in a bed. In certain embodiments, the system includes a light unit having a wireless receiver, a power source, an electrical connection for transferring power from the power source to the light, and an electronically-operable switch. A mat is provided for placement on a floor adjacent a bed, the mat having a pair of metallized polyester layers separated by a compressible partition and connected to an inductance to form an LC circuit having an oscillation frequency dependent on the distance between the metallized polyester layers. The partition can have an uncompressed thickness which corresponds to an uncompressed oscillation frequency value. A microcomputer is electronically connected to and adapted to monitor the oscillation frequency of the LC circuit, and is programmed to compare the oscillation frequency to the uncompressed oscillation frequency value, and to determine a weight applied to the mat from the oscillation frequency. A first wireless transmitter is for transmission of a first signal adapted for reception by the wireless receiver of the light unit, and is controlled by the microcomputer. A second wireless transmitter controlled by the microcomputer is for transmission of a second signal adapted for reception by a remote receiver, the second signal including information including the value of the weight. The microcomputer can instruct the first and second wireless transmitters to transmit the first and second signals on determining that the oscillation frequency differs from the uncompressed oscillation frequency value by a predetermined amount, and on receiving the first signal the switch of the light unit allows power to the light, lighting the light.

Particular features can include a timer circuit in the light unit, so that on receiving the first signal the timer circuit begins a count of a predetermined amount of time, and at the end of the count the switch cuts off power to the light. The first signal may be a Bluetooth signal, and the system can include at least one signal extender for receiving the first signal from the first wireless transmitter and retransmitting the first signal to the wireless receiver of the light unit. The second signal may use a GSM (Global System for Mobile Communications) protocol, and/or may include an alarm message indicating that the mat has been activated. The mat can include a plurality of light-emitting diodes, and when the microcomputer determines that the oscillation frequency differs from the uncompressed oscillation frequency value by a predetermined amount the plurality of light-emitting diodes are lit. After a predetermined amount of time, the light-emitting diodes can be turned off.

In particular embodiments, the mat has a first surface and an oppositely facing second surface, each of the first and second surfaces being substantially parallel to the first and second metallized polyester layers. Such a mat may be reversible so that the system is operable when the first surface contacts the floor and the second surface faces away from the floor, or when the second surface contacts the floor and the first surface is directed away from the floor. The light unit may have a receptacle for plugging the light into the light unit, or may have a hard-wired connection with the light.

In some embodiments, a wireless night light system for turning on a light remote from an individual in a bed has a light unit having a wireless receiver, a power source, an electrical connection for transferring power from the power source to the light, and an electronically-operable switch. A mat is provided for placement on a floor adjacent a bed, the mat having a weight sensor for measuring weight values of weight applied to the mat and electronically connected to a microcomputer, a first wireless transmitter controlled by the microcomputer for transmission of a first signal adapted for reception by the wireless receiver of the light unit, a second wireless transmitter controlled by the microcomputer for transmission of a second signal adapted for reception by a remote receiver, the second signal including information including the value of the weight, and a plurality of light-emitting diodes fixed to the mat and controlled by the microcomputer. The microcomputer is programmed with an initial weight value and is adapted to compare weight values received from the weight sensor with the initial weight value, and to instruct the first and second wireless transmitters to transmit the first and second signals on determining that a received weight value exceeds the initial weight value. When the first signal is received by the light unit, the switch of the light unit allows power to the light, lighting the light.

These and other embodiments are described in further detail below.

DESCRIPTION OF THE ILLUSTRATED EMBODIMENTS

Figure 1:
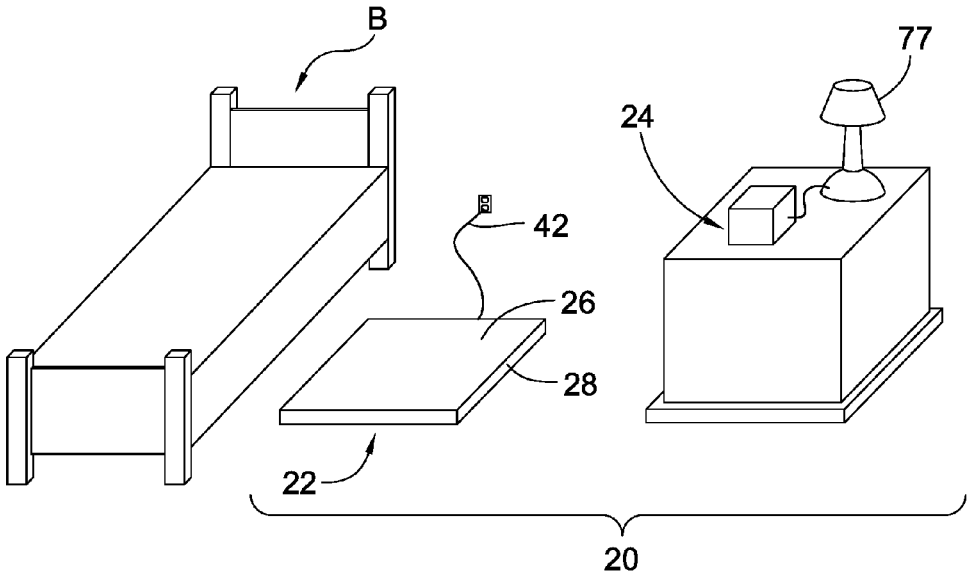
FIG. 1 is a perspective view of an embodiment of a system according to this disclosure in use.

For the purposes of promoting an understanding of the principles of the disclosure, reference will now be made to the embodiments illustrated in the drawings and specific language will be used to describe the same. It will nevertheless be understood that no limitation of the scope of the claims is thereby intended, and alterations and modifications in the illustrated device, and further applications of the principles of the disclosure as illustrated therein are herein contemplated as would normally occur to one skilled in the art to which the disclosure relates.

Referring now generally to the drawings, embodiments of a night-light and alert system 20 are shown and disclosed. It will be understood that the system includes various components that are usable with the remainder of the system as well as by themselves or in connection with other devices. System 20 in the illustrated embodiment includes a mat 22 and a light unit 24. As discussed further below, in general an application of sufficient force to mat 22 activates light unit 24, and may also activate other features of system 20.

Mat 22 in this embodiment is a generally flat, low-profile piece for placement on a floor. It is shown in the drawings as substantially rectangular, but it will be understood that the planar shape of mat 22 may be square, circular, oval or other shape that permits operation as discussed below. The low profile is desirable insofar as mat 22 is for stepping on by a patient, elderly person or other individual, and so should present a minimum height differential with respect to the underlying floor so that the individual need not step up or down significantly in order to step onto or off of mat 22.

Mat 22 includes an external protective layer or cover 25 having opposed faces 26 and 28 joined by one or more side surfaces 30. One of faces 26 and 28 will contact a floor when mat 22 is in use, and the other face will face upward from the floor. Thus, in the embodiment of FIG. 1, face 26 is an upper or upward-looking face, and face 28 is a lower or floor-contacting face. In some embodiments, faces 26 and 28 are intended to face only in one orientation, i.e. there are dedicated lower, floor-facing and upper surfaces. In such a case, the floor-facing surface can include reinforcing material, non-slip material or other floor-engaging material or features as are known. The upper surface in such a case may have a decorative or other aesthetically-pleasing appearance. In other embodiments, mat 22 may be reversible, so that either face may be placed against the floor. It will be understood that layer 25 may be the outermost layer of mat 22, or may be enclosed by a plastic, fabric or other protective or decorative cover, layer or sleeve.

Layer 25 is preferably a relatively soft, pliable and/or compressible substance, for comfort for the feet of the user and to minimize the chance of damage to features within layer 25. Layer 25 may be a unitary item, or may be formed of two or more pieces to form an inner pocket or chamber 34. Within chamber 34 in the illustrated embodiment are first and second metallized polyester layers 36, 38, separated by a partition element 40. Partition element 40 is a firm foam in one embodiment, having an unstressed thickness D and being compressible on application of force or weight to mat 22. Preferably the compression in partition element 40 is proportional to the amount of force applied. Layers 36, 38 are electronically connected by wire(s), printed circuit(s) or other physical connection to each other, and inductance L, to form an RC/LC oscillator circuit 41, in which layers 36, 38 act as a capacitor. A power source 42 is electrically connected to circuit 41. Power source 42 is a connection to main building power in the illustrated embodiment, e.g. a plug connection to an available AC power socket, either directly or via intermediate plug(s) or cord(s). In other embodiments, power source 42 can additionally or alternatively include one or more batteries (e.g. rechargeable batteries), which are located within layer 25 (preferably along an edge) or in a separate side module connected to layer 25 or other parts of mat 22.

The RC/LC oscillator circuit 41 has both qualitative and quantitative functions in this embodiment. First, it determines when a weight (or a sufficient weight) is on mat 22 to warrant turning on a light. When layers 36, 38 are separated by distance D (i.e. the unstressed thickness of partition 40), a particular frequency in energized circuit 41 results. That value (representing zero weight on or an initialized condition of mat 22) may be stored in computer 44 or memory associated with it. A differing frequency represents a change in the distance between layers 36, 38 from weight applied to mat 22. A controller or microcomputer 44 is electronically connected to circuit 41 (e.g. to layers 36, 38), to power source 42, and to communications modules as discussed further below. Computer 44 has hardware and software for analyzing signals received from the RC/LC oscillator circuit and determining from them the value of the weight placed upon mat 22. In a particular embodiment, computer 44 compares that value to a preferred, minimum or other value (e.g. in electronic data storage in or associated with computer 44) to determine whether to send one or more signals to the communications modules. For example, computer 44 might compare the weight value received from the circuit to a minimum value representing a pet and only send signal(s) if the received value is greater than that minimum value. In that way, accidental activations by a dog or cat stepping on mat 22 can be avoided.

Second, circuit 41 determines the particular value of the weight applied to the mat 22. As already indicated, applied weight decreases the distance between layers 36, 38, causing a proportional change in the value of the capacitance. The RC/LC oscillation frequency will also change accordingly. By measuring the change in the frequency the value of the weight of the load can be determined by microcomputer 44.

Mat 22 in the illustrated embodiment further includes a first communications module 50 for communicating with light unit 24, and a second communications module 52 for communicating with a remote receiver, such as a mobile telephone, computer or other communications device. First communications module 50 is electronically connected to computer 44, to accept transmission instructions from computer 44. Module 50 includes a wireless transmitter 54, which in a particular embodiment is a Bluetooth low energy device (BLE 4.0), and in the illustrated embodiment further includes a range extender or wireless repeater 56. Transmitter 54 (and range extender 56 if present and used) are compatible with a receiver in light unit 24, so that "turn on" and/or "turn off" signals can be sent from transmitter 54 and received at light unit 24, as will be discussed further below.

Second communications module 52 is electronically connected to computer 44, to accept transmission instructions from computer 44. Module 52 includes a transmitter 60 for transmitting information to a mobile telephone, external computer or other data receiver (not shown). Transmitter 60 in this embodiment is capable of linking to cellular or other telephone or data transport network, for sending information gathered by mat 22 to a remote telephone or other device. In specific embodiments, a GSM-standard transmitter is provided, and is capable of data transportation under one or more available data transport protocols (e.g. 2G, 3G, 4G).

Computer 44 includes or is connected or interfaced to a real-time clock (RTC) 64. Time values from RTC 64 are used by computer 44 to determine amounts of time that may elapse between separate steps on mat 22. Absolute time values or measures of elapsed time may be used by computer 44 to activate features of system 20, as will be discussed further below.

Figure 2:
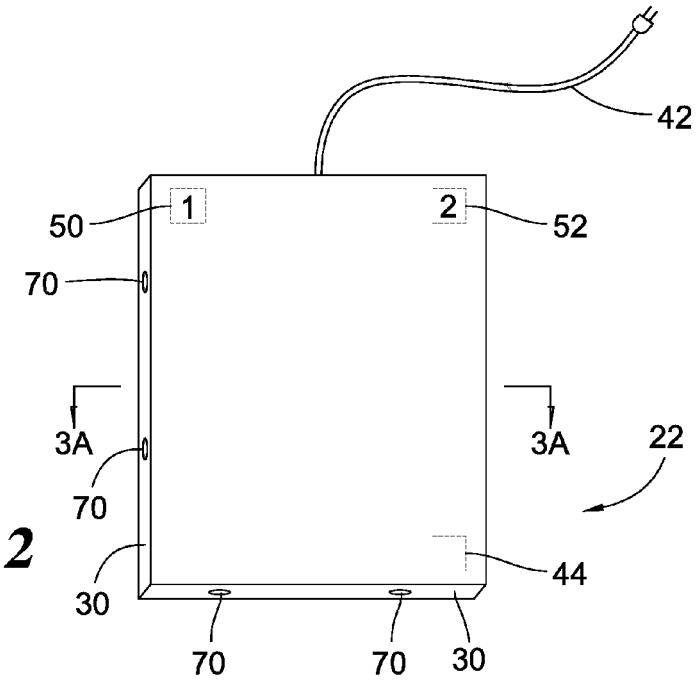
FIG. 2 is a perspective view of a portion of an embodiment of a mat of the embodiment illustrated in FIG. 1.
Figure 3A:
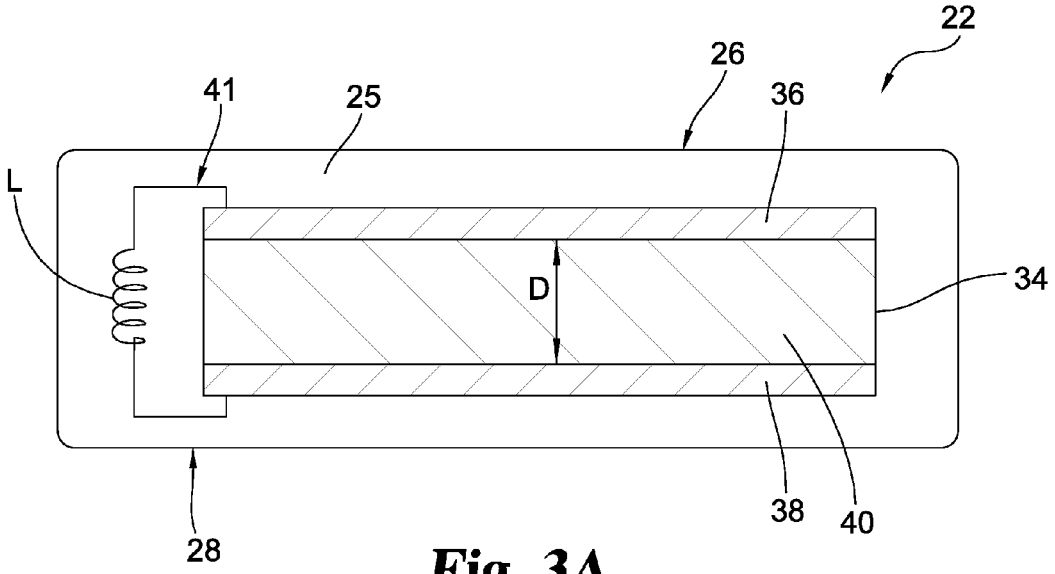
FIG. 3A is a part-cross-sectional view of the mat embodiment illustrated in FIG. 2 in a rest or unstressed state, taken along the lines 3A-3A and viewed in the direction of the arrows.
Figure 3B:
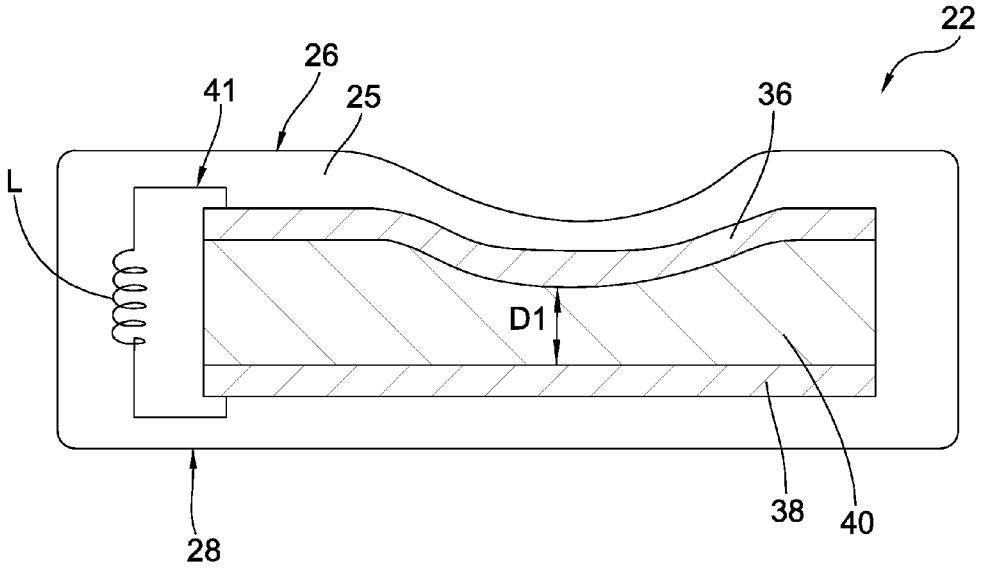
FIG. 3B is a view as in FIG. 3A in a stressed or weight-bearing state.
Figure 4:
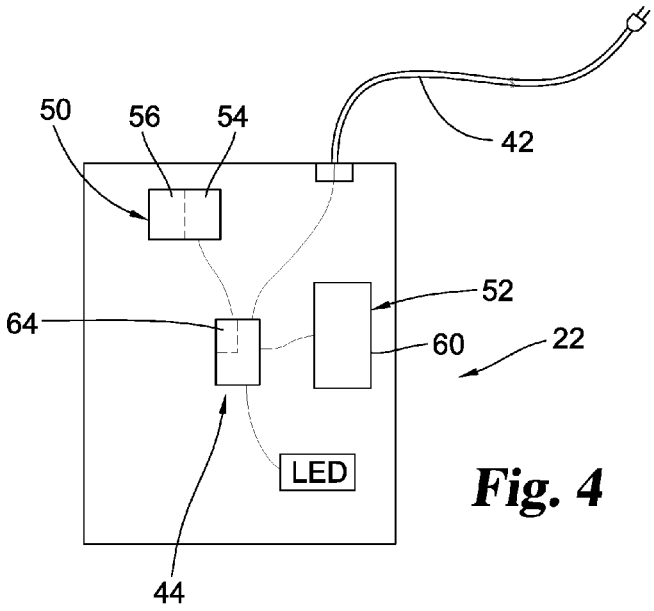
FIG. 4 is a schematic view of an embodiment of a mat as illustrated in FIG. 1.
Figure 5:
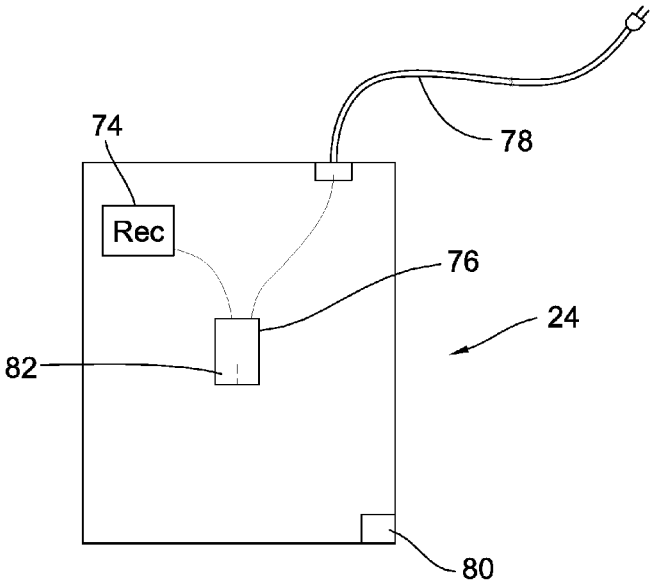
FIG. 5 is a schematic view of an embodiment of a light unit as illustrated in FIG. 1.
Figure 6:
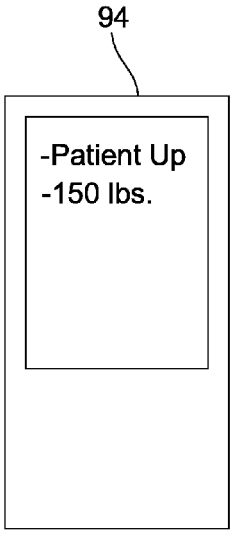
FIG. 6 is a plan view of an embodiment of a receiver (e.g. mobile telephone) usable with the system illustrated in FIG. 1.
Figure 7:
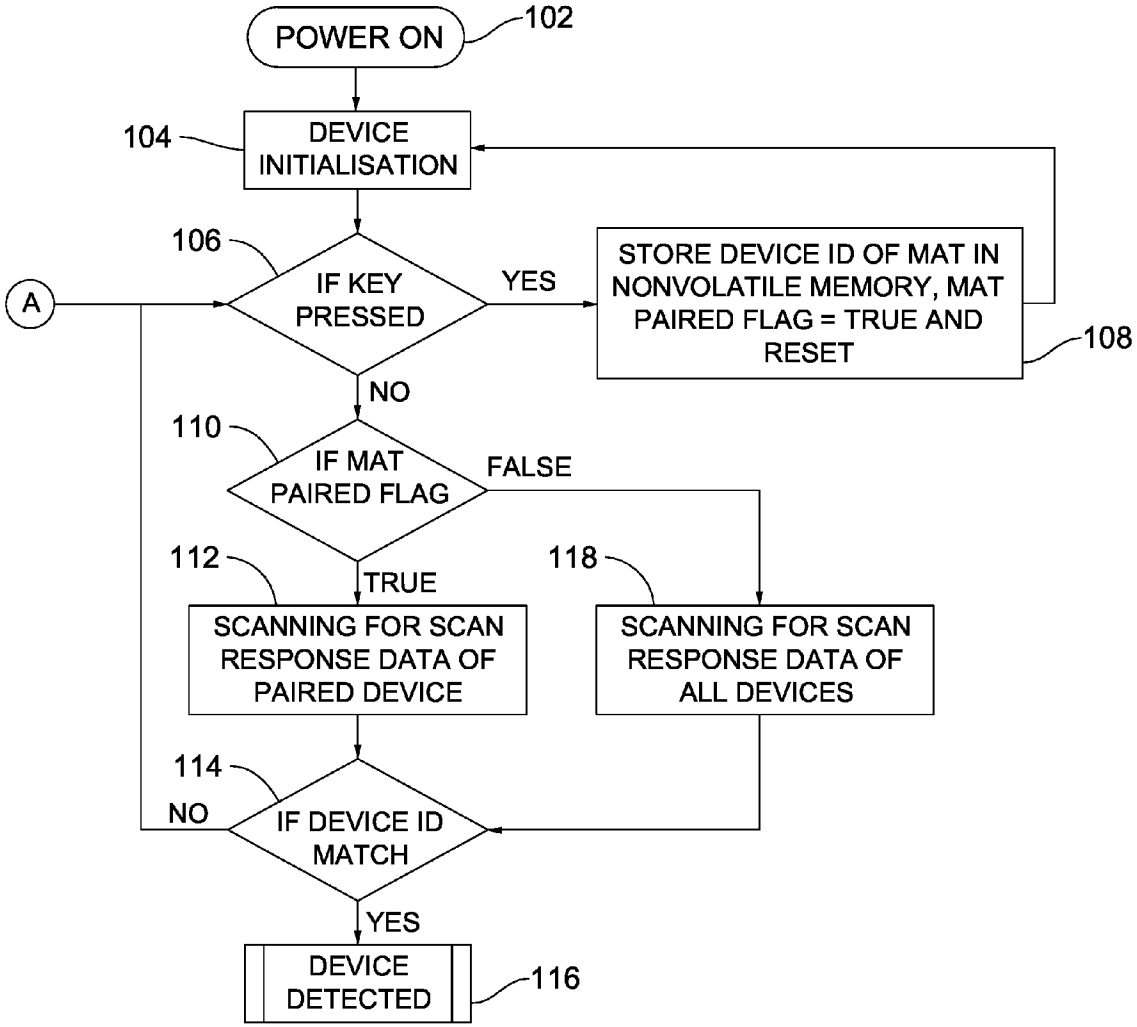
FIG. 7 is a representative flow chart indicating an embodiment of initialization, detection and/or connection between an embodiment of a mat and an embodiment of a light unit as described herein.
Figure 8:
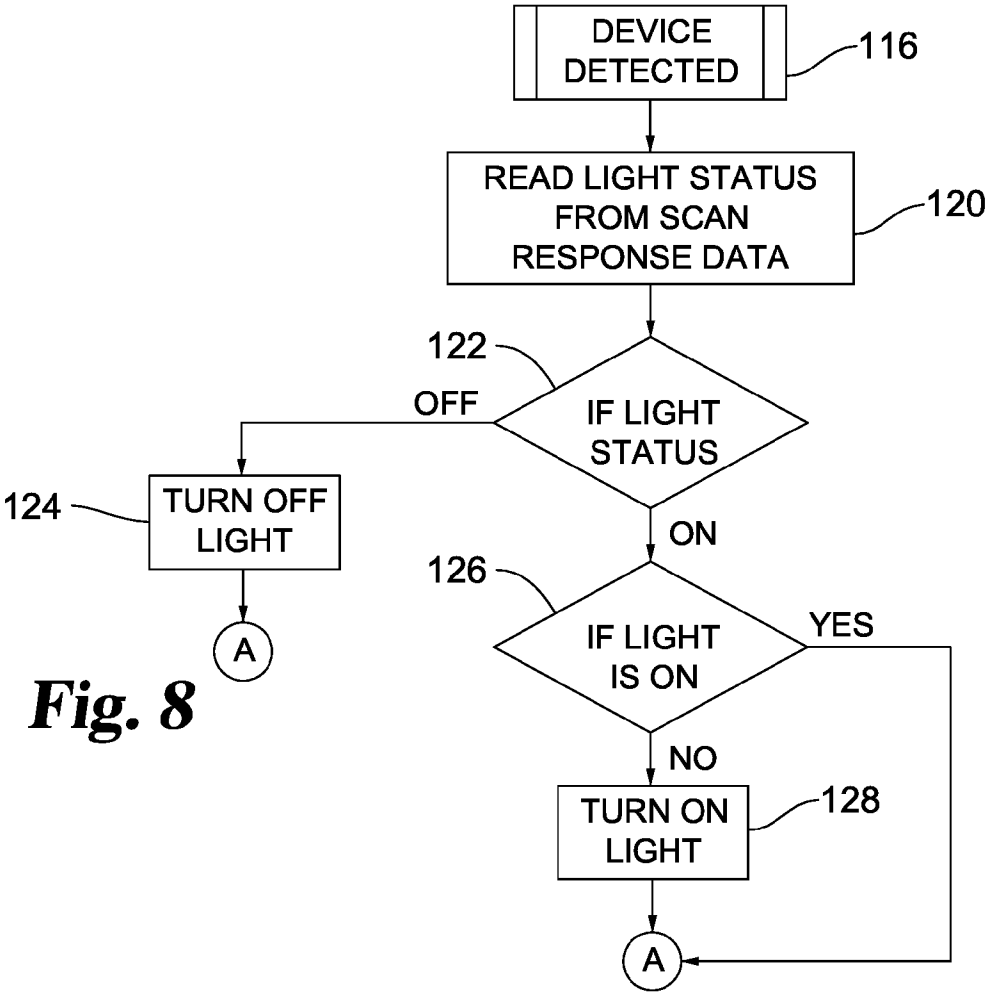
FIG. 8 is a representative flow chart indicating a part of the embodiment of FIG. 7.

Embodiments of mat 22 may also include one or more lights 70 to illuminate mat 22 and/or the space around it when mat 22 is stepped on. In the illustrated embodiment, several lights 70 are fixed to or embedded in layer 25 of mat 22 and electronically connected to power source 42 and governed in operation by computer 44. Lights 70 may be light-emitting diodes (LEDs) in particular embodiments, for their high illumination with small size and power requirement. Lights 70 may be arranged in or along each edge of mat 22 (as indicated in FIG. 2), so that a wide area of illumination around mat 22 is cast when lights 70 are on.

As seen in the Figures, light unit 24 in the illustrated embodiment is a device that plugs into a wall receptacle to receive power, and allows lamp L to be plugged into it so that light unit 24 can turn lamp L on and off. In other embodiments, a light unit 24 may be wired directly to a stand-alone lamp or to a wall or ceiling light fixture. In such a case, light unit 24 permits current to flow through it to energize the light as discussed above.

Light unit 24 includes a receiver 74 for receiving signals from transmitter 54 of mat 22, and a module, microcomputer or circuit 76 for switching lamp 77 on or off. A power source 78 (a plug for connection to a wall outlet of a house, care facility or other building in the illustrated embodiment) provides electrical power to light unit 24, and power in the form of an output load to lamp 77. A receptacle 80 is provided into which a plug of lamp 77 can be inserted for electrical connection. Receiver 74 in a particular embodiment is a BLE 4.0 chip (e.g. CC2541), perhaps with a range extender (not shown). Circuit 76 can include receiver 74 or be electronically connected to it, and regulates a link between power source 78 and receptacle 80, so as to permit connection and disconnection of power. When receiver 74 receives a "turn on" message from transmitter 54 of mat 22, circuit 76 allows electrical power to move from power source 78 to receptacle 80 and thus to lamp L. On receiving a "turn off" message (or second "turn on" message, as discussed below) from transmitter 54 of mat 22, circuit 76 switches off disconnects the load from power source 78 to receptacle 80. In particular embodiments, circuit 76 includes a real-time clock (RTC) 82, which counts time after a "turn on" message is received at receiver 74. After a predetermined period of time elapses (e.g. 5 minutes, 10 minutes, 15 minutes or another predetermined amount of time), circuit 76 can automatically turn off the electrical load. In such embodiments, an input (not shown) is provided so that a user (whether patient, caregiver, or other individual) can set a desired amount of time, or can deactivate an automatic turn-off function.

In operation, mat 22 of system 20 is placed on the floor adjacent a bed B, preferably toward the middle of one side of bed B where an individual will place his or her feet when arising from the bed. In embodiments in which mat 22 is approximately the length of a bed, placement distinctions may be less important, while in embodiments in which mat 22 is relatively small, e.g. 4-5 square feet or less, care should be given to placing mat 22 in a location that will make it easy or automatic to use when the individual rises from bed B. While placement next to bed B at the location on a floor where an individual will place his or her feet when arising from bed is preferable insofar as system 20 can be activated immediately upon arising, it will be understood that mat 22 may be placed elsewhere if desired, such as in or on the way to a doorway.

When the individual gets out of bed B and steps on mat 22, the individual's weight presses layer 36 (or a part of it) toward layer 38. Layers 36 and 38 do not touch each other, but remain separated by partition 40. The change in distance between layers 36 and 38 changes the frequency of the LC/RC circuit 41 formed with layers 36 and 38. The frequency change is read by computer 44, and computer 44 on reading that frequency change instructs transmitter 54 to send a "turn on" signal. The magnitude of the frequency change indicates the amount of the force, i.e., the individual's weight, as noted above. Computer 44 in particular embodiments converts the frequency change to a weight value and compares that weight value to a stored value, which may indicate a minimum or target value. If the determined weight value is greater than a minimum stored value, or within a predetermined range around a target value, then computer 44 sends a "turn on" signal. If not, then no "turn on" signal is sent. In embodiments of mat 22 that include one or more lights 70, when computer 44 determines that a "turn on" signal should be sent, it also allows power to lights 70 to light them.

A "turn on" signal sent from transmitter 54 is received by receiver 74 of light unit 24. On receiving the signal, circuit 76 allows electrical power to pass from plug or other source 78 to receptacle 80, and on to lamp 77. In this way, lamp 77 is turned on. In embodiments in which mat 22 and/or light unit 24 have a time circuit 64 or 82, counting time begins when the "turn on" signal is sent or received, and/or when power begins running to lamp 77. In the case of circuit 64, if a predetermined time is counted, a second signal to turn off power is sent by transmitter 54 and received by receiver 74, so that light unit 24 terminates power to lamp 77. In the case of circuit 82, after a predetermined time is counted by circuit 82, light unit 24 terminates power to lamp 77, so that lamp 77 is no longer illuminated. In embodiments of light unit 24 that do not have a time circuit 82, a second "turn on" signal received from transmitter 54 of mat 22 (e.g. by the individual stepping on mat 22 a second time, while lamp 77 is illuminated) causes light unit 24 to terminate power to lamp 77. Similarly, in some embodiments a second "turn on" signal received from transmitter 54 while a time circuit 64 and/or 82 is counting time but has not yet reached the predetermined amount of time results in power terminated to lamp 77, and the termination of counting or other reset of circuit 64 and/or 82. In embodiment having lights 70 on mat 22, lights 70 may be energized and de-energized along with or in correspondence with lamp L, or they may operate independently of light unit 24.

One or both of modules 50, 52 may also send a signal to another receiver 94 associated with a caregiver, for instance. As an example, when computer 44 of mat 22 determines that a "turn on" signal should be sent, that signal may be received not only by receiver 74 of light unit 24 but also by a receiver associated with a caregiver (not shown), either directly or by way of signal repeater(s). Module 52 of mat 22 can alternatively or additionally send a signal to a receiver (e.g. a mobile telephone 94 or other device, in form(s) such as text message or e-mail, as suggested above). Such a signal includes at least a notification that mat 22 has been activated, e.g. that a "turn on" signal has been generated. Further, the weight value generated by computer 44 of mat 22 can be sent via GSM module 52. In this way, the caregiver can not only verify that the patient was the person who activated mat 22 (or can establish which of two or more people activated mat 22), but can also receive and store the weight value, as a datum concerning the patient's health. With such notifications, the caregiver can thus be aware that the individual has gotten out of his or her bed, and can render assistance, investigate, or take other steps as may be warranted.

In particular embodiments, system 20 and/or its software provides methods of operation that include one or more of the following steps. In the following description, unless otherwise stated operational features and steps are a part of mat 22 and/or its computer 44. It will be understood that with wireless communication capabilities as discussed herein, electronic features or steps may be present in and/or performed by other components in or associated with system 20.

System 20 or mat 22 is initialized 104 with respect to light unit 24 to be operated, and its communications software and/or hardware (e.g. computer 44) is linked communicatively to a messaging system (e.g. SMS, GSM, e-mail or the like). For example, in a system in which mat 22 is not directly connected (e.g. hard-wired to or connected by wire connection) to light unit 24 (or lamp 77) but is connected wirelessly, the connection between mat 22 and light unit 24 can be initialized when mat 22 is powered on (102, 104). Where mat 22 and light unit 24 are not already initialized with each other, key programming 106 of one or both of mat 22 and light unit 24 may be done, e.g. to store a device identification code identifying the mat in a non-volatile memory 108, to form a pairing. When mat 22 is powered on in this exemplary embodiment, if mat 22 (for example) has one or more particular paired light units 24 (110), mat 22 scans for the paired device (112). When a device identification match is found (114), the connection is made and a device-detected subroutine is called (116). Where no particular device relationship has been established, mat 22 and/or light unit 24 can scan for any related device (118) in particular embodiments, or can refer the user to program in identification of a desired device. Where no connection is made, then a request for further information from mat 22 (e.g. computer 44) may be made.

Once a device is detected, an intended status of the light is read from the mat and/or light unit (120). Where the light status is "off" (122), then the light unit 24 may determine whether the light (e.g. lamp 77) is on, and if so turns off the light (124). Where the light status is "on," unit 24 may determine whether the light is on (126) and if not, it turns on the light (128).

When mat 22 has been powered on (102), its communications hardware and software (e.g. Bluetooth low energy (BLE) and/or cellular (GSM)) is initialized (104), as is its weighing hardware and software. Mat 22 continuously monitors for the presence of a person, as indicated above. When a person is detected (130), e.g. when a weight is detected that is sufficient to be a person or that correlates with a person's weight previously programmed into mat 22, a first timer ("Timer1") is started (132), and a light-status subroutine is initiated (134). Timer1 is for multiple-detection avoidance, e.g. a short timer intended to keep mat 22 or system 20 from starting multiple times during one step by a patient. The subroutine determines the existing status of a "person detected" indicator in mat 22 (142), and if that indicator is "false" (i.e. mat 22 is not in an activated state" then the software takes one or more of the following actions: (1) set the light status in "scan response data" of the mat to "on"; (2) turn on the illumination (e.g. LEDs) in or on the mat itself; (3) activate a second timer ("Timer2," representing an amount of time to leave a light (e.g. lamp 77) lit and thereafter to turn off) and/or a third timer ("Timer3," representing an amount of time to leave lights on mat 22 (e.g. LEDs 70) lit and thereafter to turn off); and (4) change the "person detected" indicator to "true" (144). If, however the "person detected" indicator is "true" when the light-status subroutine is initiated (indicating that a person has recently stepped on the mat and its illumination is on), then the software takes one or more of the following actions: (1) turn off the illumination in or on the mat itself; (2) deactivate Timer2; (3) activate a fourth timer ("Timer4"); and (4) change the "person detected" indicator to "false" (146). In particular embodiments, all of the above steps are taken with the light-status subroutine. The light-status subroutine is called (and indicated steps taken) each time a person is detected on mat 22, i.e. every time a person steps on mat 22.

If a person is not detected (130), or once the light-status subroutine has completed, a GSM-subroutine is intiated (136). The GSM-subroutine's purpose is to determine whether the patient has been absent for longer than a predetermined period of time, and if so, to send a message to a desired person or location. The GSM-subroutine determines first whether Timer2 has elapsed (148). If Timer2 has not elapsed, i.e. the light and mat illumination remains on, then the GSM-subroutine is exited. If Timer2 is running, that means that only a short period has elapsed since the patient stepped on the mat, and so no message is needed at that moment. If Timer2 has elapsed when the GSM-subroutine is initiated, then the next determination is whether the "person detected" indicator (set during the light-status subroutine) is true (150). If not, then the GSM-subroutine ends. If the "person detected" indicator is true, indicating that the patient has stepped on the mat and the time elapsed since then is greater than the set value of Timer2, then a message (e.g. SMS message) is sent to one or more registered numbers (152). As noted above, the message indicates to the recipient (e.g. a caregiver) that the patient has not returned to the mat. He or she may then take steps to check on the patient.

Following the GSM-subroutine in this embodiment is a phone-subroutine (138). The phone-subroutine's purpose is to provide weight information to a device for display or collection and/or to schedule further data collection. Such a device for display or collection (and the subroutine) is referred to with the term "phone," but it will be recognized that a phone (e.g. a smart phone) is only one example of such a device. The phone-subroutine begins by determining whether the hardware and/or software of mat 22 has a connection to a phone (154), and if not the subroutine ends. If so, a measurement of the weight on the mat (e.g. the weight of the patient) is taken (156). Once that measurement is taken, determinations are made as to what options (if any) for the data the user has selected. For example, if the user has selected a "weight display" option (158), then the weight value determined by the measurement is sent to the phone and/or such data can be written into one or both of memory (e.g. flash memory) and the user's configured schedules (160, 162). If the user has selected a "scheduler" option (164), e.g. to record the data and schedule a follow-up or further collection, then one or both of data writing and sending of weight values consistent with the scheduler can be done (160, 162). If neither option is selected in this embodiment, or if the phone is disconnected, then the phone-subroutine terminates. Further, if the software determines that the data has been handled as desired, and no further data has been received, the phone-subroutine may terminate.

Figure 9:
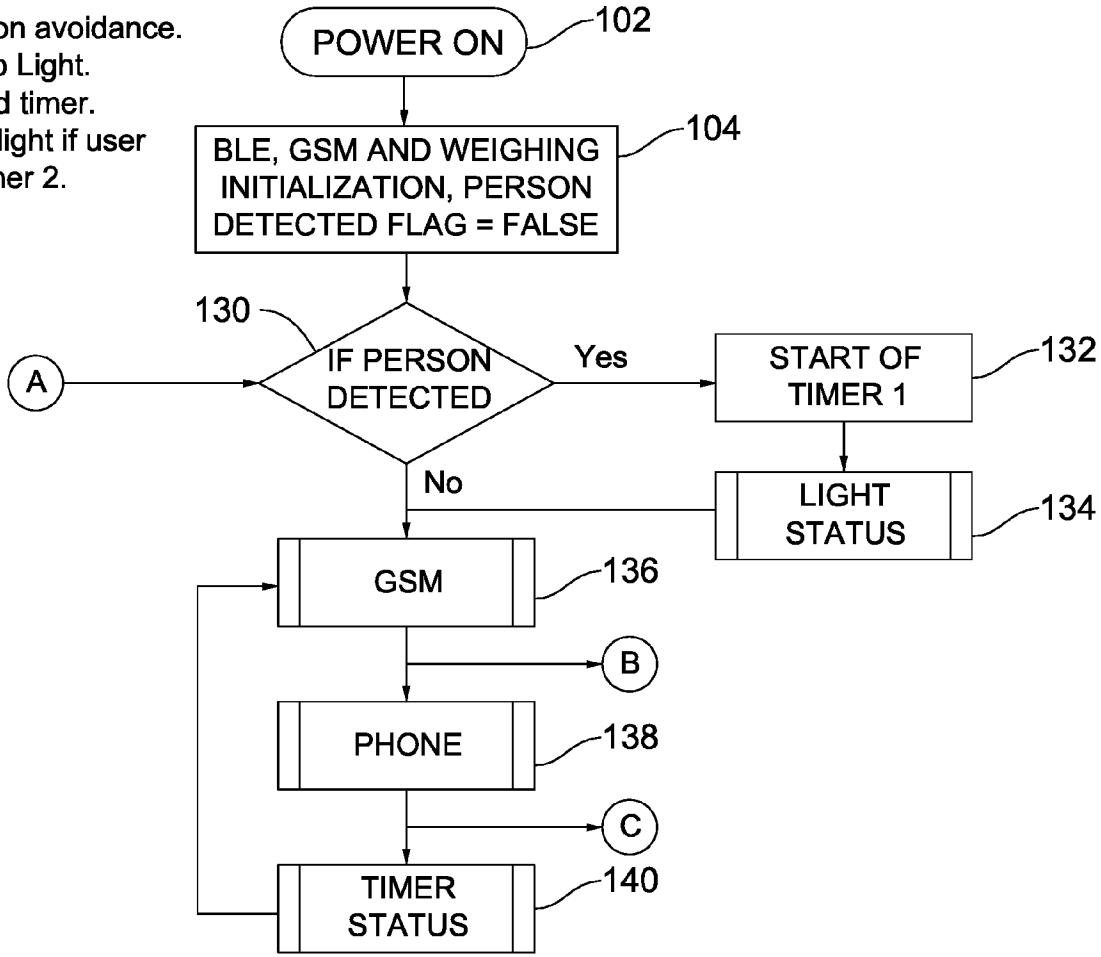
FIG. 9 is a representative flow chart indicating an embodiment of operation of a system as described herein.
Figure 10:
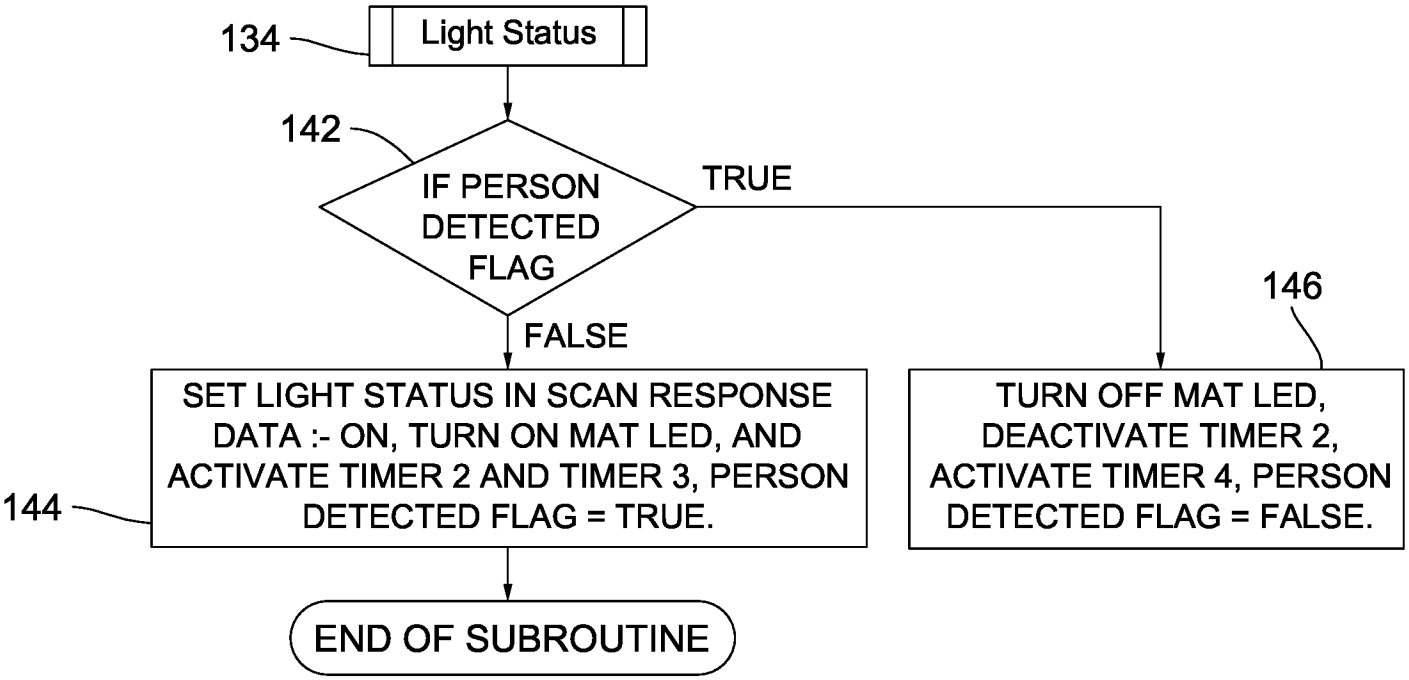
FIG. 10 is a representative flow chart indicating a part of the embodiment of FIG. 9.
Figure 11:
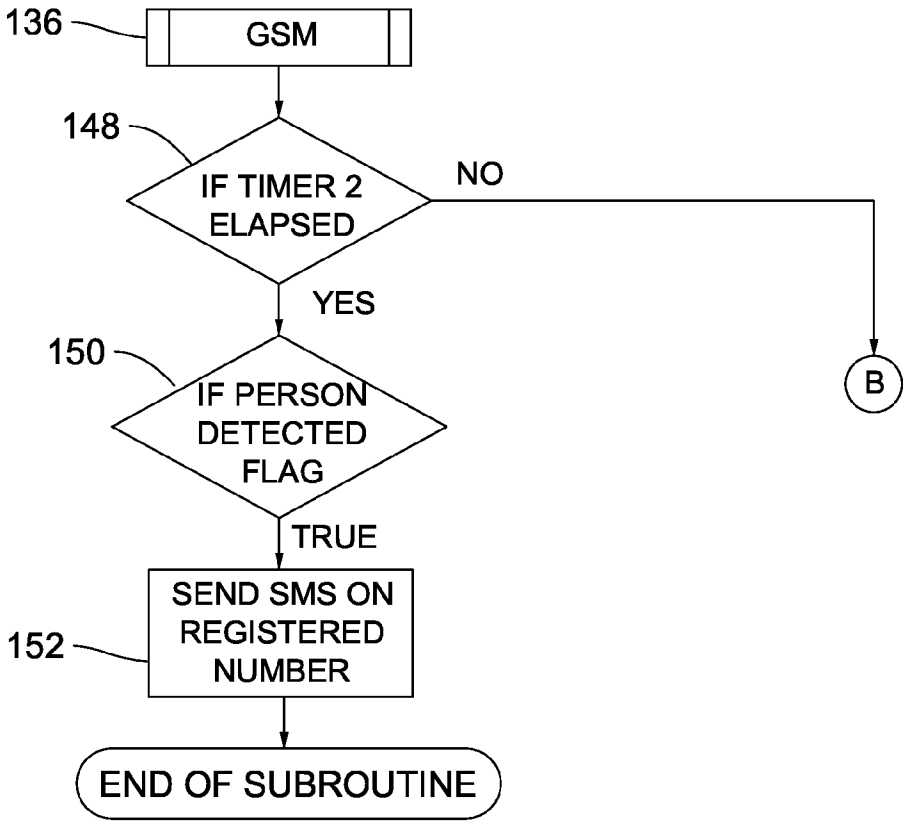
FIG. 11 is a representative flow chart indicating a part of the embodiment of FIG. 9.
Figure 12:
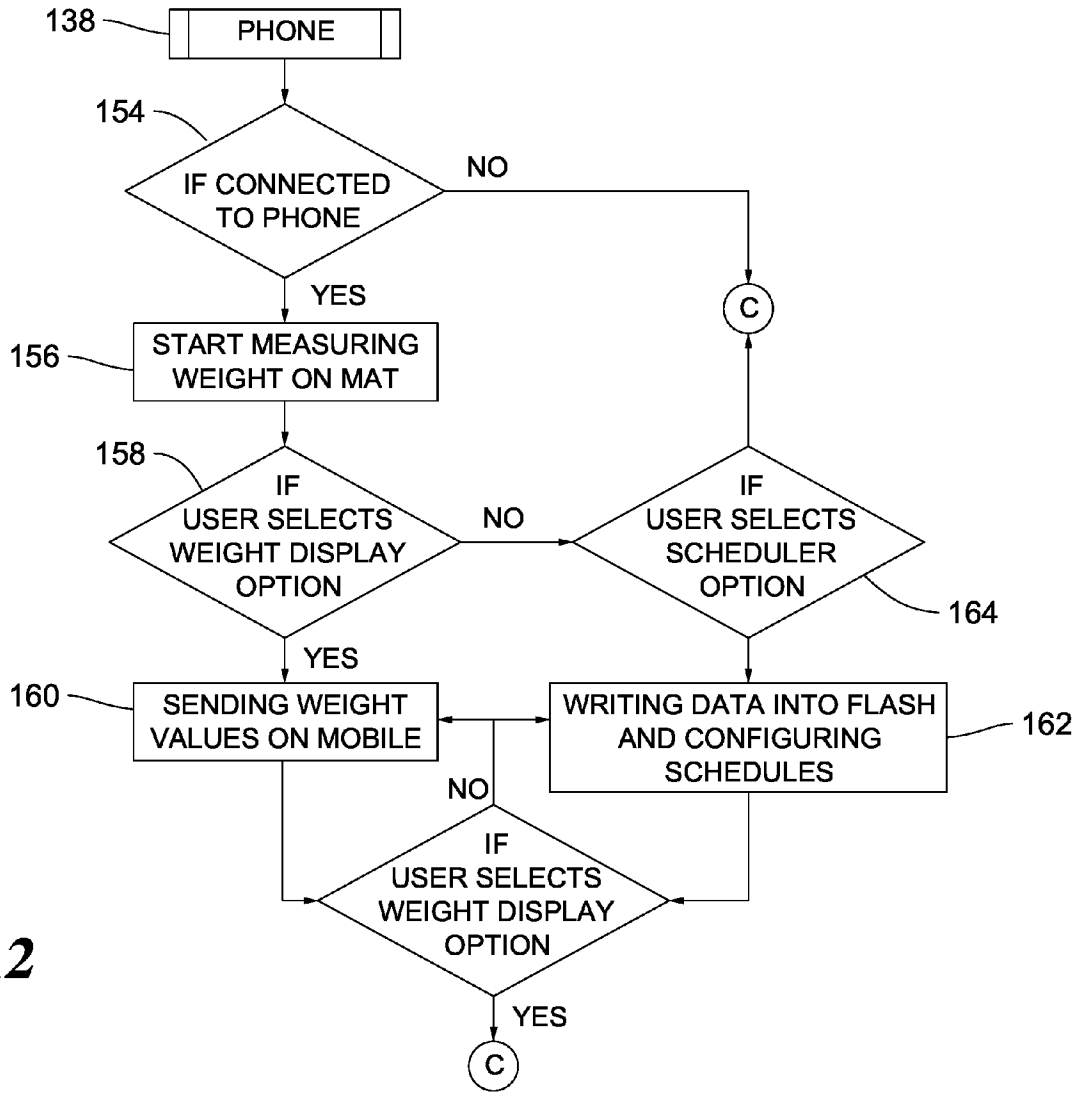
FIG. 12 is a representative flow chart indicating a part of the embodiment of FIG. 9.
Figure 13:
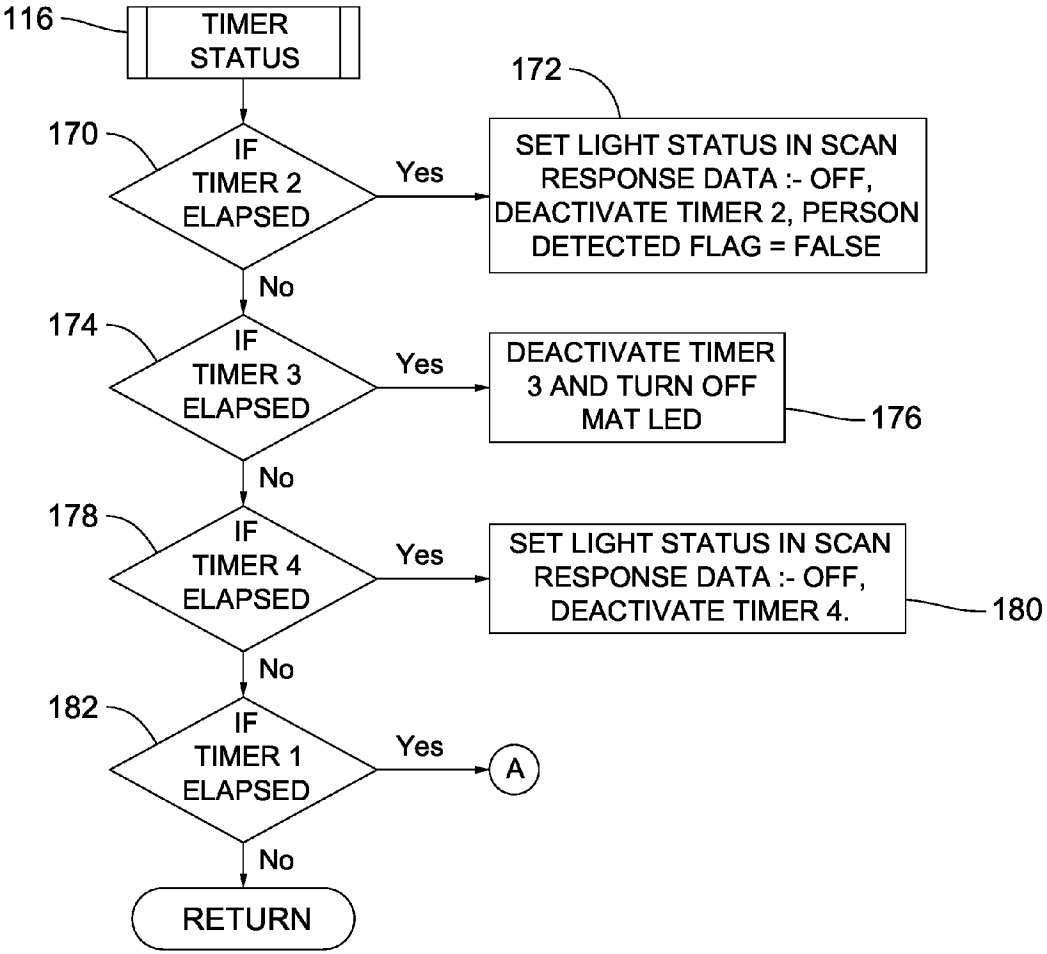
FIG. 13 is a representative flow chart indicating a part of the embodiment of FIG. 9.

In the illustrated embodiment, once the GSM- and phone-subroutines have terminated, a timer-status subroutine is initiated (116). The timer-status subroutine's purpose is to determine whether one or more timers have elapsed or are still running, and to take steps based on those determinations. The timer-status subroutine determines whether Timer2 has elapsed (170), i.e. a predetermined period has run since a person stepped on the mat, and if so then the light status is changed to "off," a wireless signal is sent to light unit 24, and the light (e.g. lamp 77) turns off (172). Additionally, Timer2 is deactivated, and the "person detected" indicator is changed to "false" (172). The timer-status subroutine determines whether Timer3 has elapsed (174), i.e. a predetermined period has run since a person stepped on the mat, and if so then Timer3 is deactivated and the mat illumination (e.g. LEDs 70) is turned off (176). The timer-status subroutine also determines whether Timer4 has elapsed (178), i.e. a predetermined period starting with a second time stepping on the mat while Timer2 was running has expired, and if so then Timer4 is deactivated and the light status is changed to "off," a wireless signal is sent to light unit 24, and the light turns off (180). The timer-status subroutine determines whether Timer 1 has elapsed (182), and if so the subroutine ends and the software returns to a person detection mode (e.g. FIG. 9). If the timer-status subroutine determines that Timer1 has not elapsed, then the subroutine begins again. As indicated in FIG. 13, the order of determining timer status may be the order given above in particular embodiments.

Figure 14:
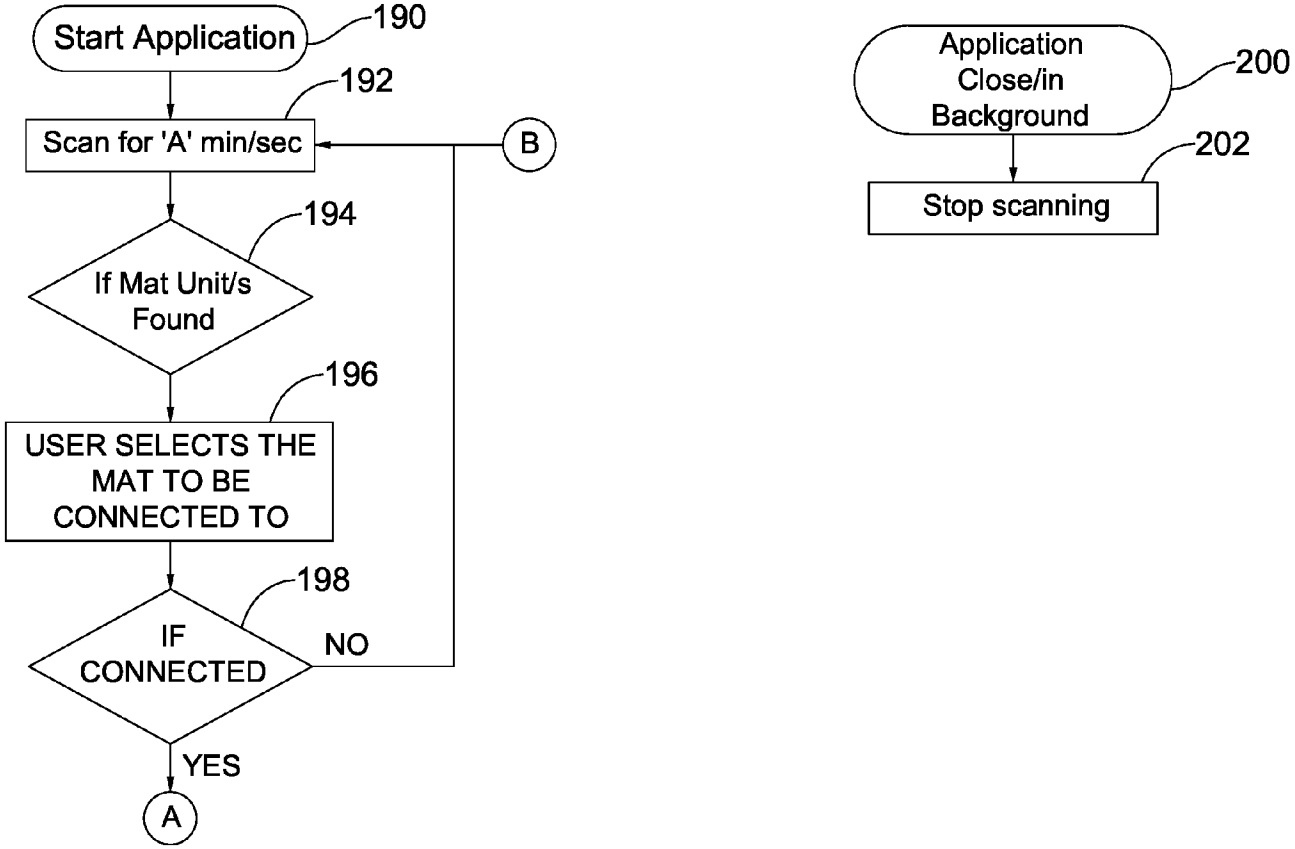
FIG. 14 is a representative flow chart indicating an embodiment of connection and/or interaction of a smart phone or other input or display device with or in a system as described herein.
Figure 15:
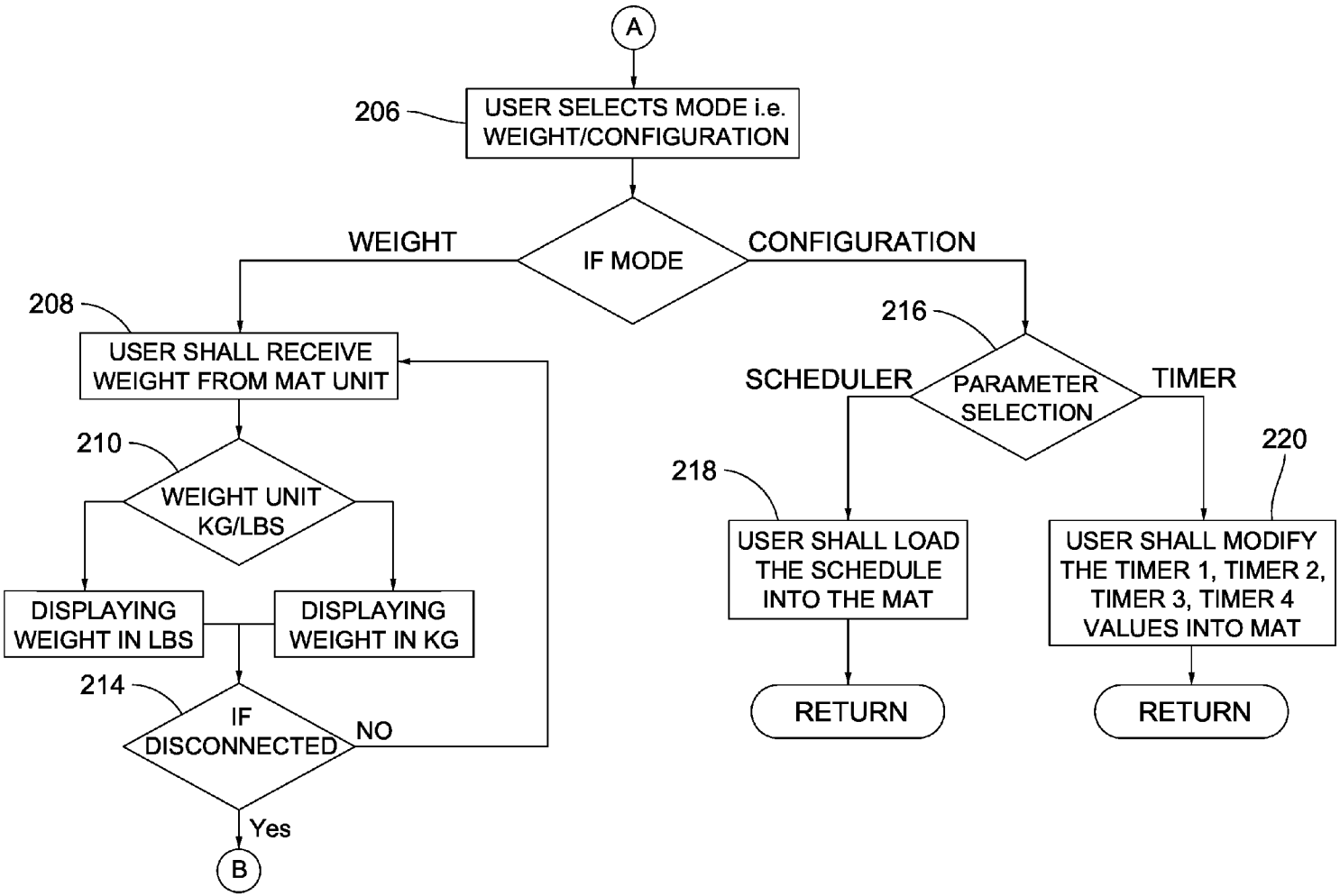
FIG. 15 is a representative flow chart indicating a part of the embodiment of FIG. 15.

A remote device's (e.g. smart phone) usage with regard to system 20 is indicated in FIGS. 14-15 in a particular embodiment. An application previously loaded onto the phone is started (190), and then scans over a predetermined amount of time (192) for one or more mat units 22. If a mat unit (or desired mat unit(s)) is not found in that time period (194), then the application terminates or advises the user of the failure. If a mat unit or units is found (194), the user then selects the mat(s) to connect the phone or other device to (196). A check to confirm that the device is connected to the mat(s) is performed (198), and if there is no connection, a new scanning period and or operation is begun. If a connection is confirmed, then operation of the system as indicated below proceeds. In the illustrated embodiment, if the application is closed or goes into background (200), scanning for mat(s) stops (202).

Once the connection is confirmed, the user uses the application to select a mode of operation (206), e.g. a weight display mode or a schedule configuration mode. If the weight display mode is selected, then the user will receive weight information (208) from the mat at the device (e.g. smart phone). The user can select or set up the application to display the weight data in pounds or kilograms or potentially other desired units (210). Once set up, a confirmation is made that the device is connected to the mat (214), and if it is disconnected, the application returns to the scanning mode noted above. If connected, monitoring and display of weight data can continue.

If the schedule configuration mode is selected, the user will then have a choice of parameters to alter or create in this embodiment (216), if such a choice has not already been made and entered. For example, choosing a scheduler parameter allows the user to load a schedule into the mat (218), e.g. a schedule for weight measurement or for turning the mat's illumination or the light to which the mat is connected on and/or off. Choosing a timer parameter in this embodiment allows a user to enter and/or modify time values for the timers (e.g. one or more of Timer1, Timer2, Timer3, Timer4) noted above (220). Once such selections are made in any or all of the available parameters, the application returns to a select and/or scanning mode, as described above.

While embodiments have been illustrated and described in detail in the drawings and foregoing description, the same is to be considered as illustrative and not restrictive in character, it being understood that only particular embodiments have been shown and described and that all changes and modifications that come within the spirit of the disclosure are desired to be protected. It is to be noted that features particularly described above with respect to one or more embodiments may be used with or incorporated in other embodiments as well.

What is claimed is:

1. A wireless night light system for turning on a light remote from an individual in a bed, comprising:

a light unit having a wireless receiver, a power source, an electrical connection for transferring power from the power source to the light, and an electronically-operable switch;

a mat for placement on a floor adjacent a bed, the mat having a pair of metallized polyester layers separated by a compressible partition and connected to an inductance to form an LC circuit having an oscillation frequency dependent on the distance between the metallized polyester layers, said partition having an uncompressed thickness which corresponds to an uncompressed oscillation frequency value;

a microcomputer electronically connected to and adapted to monitor the oscillation frequency of the LC circuit, said microcomputer programmed to compare the oscillation frequency to the uncompressed oscillation frequency value, and to determine a weight applied to the mat from the oscillation frequency;

a first wireless transmitter for transmission of a first signal adapted for reception by the wireless receiver of the light unit, the first wireless transmitter controlled by the microcomputer, and;

a second wireless transmitter for transmission of a second signal adapted for reception by a remote receiver, the second signal including information including the value of the weight, the second wireless transmitter controlled by the microcomputer;

wherein the microcomputer instructs the first and second wireless transmitters to transmit the first and second signals on determining that the oscillation frequency differs from the uncompressed oscillation frequency value by a predetermined amount, and wherein on receiving the first signal the switch of the light unit allows power to the light, lighting the light.

2. The system of claim 1, wherein the light unit includes a timer circuit, wherein on receiving the first signal the timer circuit begins a count of a predetermined amount of time, and at the end of the count the switch cuts off power to the light.

3. The system of claim 1, wherein the first signal is a Bluetooth signal, and further comprising at least one signal extender for receiving the first signal from the first wireless transmitter and retransmitting the first signal to the wireless receiver of the light unit.

4. The system of claim 3, wherein the second signal uses a GSM (Global System for Mobile Communications) protocol.

5. The system of claim 4, wherein the mat includes a plurality of light-emitting diodes, and wherein on the microcomputer determining that the oscillation frequency differs from the uncompressed oscillation frequency value by a predetermined amount the plurality of light-emitting diodes are lit.

6. The system of claim 5, wherein after a predetermined amount of time the light-emitting diodes are turned off.

7. The system of claim 1, wherein the second signal includes an alarm message indicating that the mat has been activated.

8. The system of claim 1, wherein the mat has a first surface and an oppositely facing second surface, each of the first and second surfaces being substantially parallel to the first and second metallized polyester layers, and wherein the mat is reversible so that the system is operable when the first surface contacts the floor and the second surface faces away from the floor, or when the second surface contacts the floor and the first surface is directed away from the floor.

9. The system of claim 1, wherein the electrical connection to the light is a receptacle for plugging the light into the light unit.

10. The system of claim 1, wherein the electrical connection to the light is a hard-wired connection between the light and the light unit.

11. A wireless night light system for turning on a light remote from an individual in a bed, comprising:

a light unit having a wireless receiver, a power source, an electrical connection for transferring power from the power source to the light, and an electronically-operable switch, and;

a mat for placement on a floor adjacent a bed, the mat having a weight sensor for measuring weight values of weight applied to the mat and electronically connected to a microcomputer, a first wireless transmitter controlled by the microcomputer for transmission of a first signal adapted for reception by the wireless receiver of the light unit, a second wireless transmitter controlled by the microcomputer for transmission of a second signal adapted for reception by a remote receiver, the second signal including information including the value of the weight, and a plurality of light-emitting diodes fixed to the mat and controlled by the microcomputer;

wherein the microcomputer is programmed with an initial weight value and is adapted to compare weight values received from the weight sensor with the initial weight value, and to instruct the first and second wireless transmitters to transmit the first and second signals on determining that a received weight value exceeds the initial weight value, and wherein on receiving the first signal the switch of the light unit allows power to the light, lighting the light.

* * * * *